US005269533A

United States Patent [19]

Kellams

[11] Patent Number: 5,269,533

[45] Date of Patent: Dec. 14, 1993

[54] FIVE-PART SUPPORT POST FOR VOLLEYBALL NET

[76] Inventor: John W. Kellams, 2427 N. 6½ St., Terre Haute, Ind. 47804

[21] Appl. No.: 37,898

[22] Filed: Mar. 26, 1993

[51] Int. Cl.[5] ..... A63B 61/00

[52] U.S. Cl. ..... 273/411; 273/29 BB

[58] Field of Search ..... 273/411, 29 B, 29 BA, 273/29 BB

[56] References Cited

U.S. PATENT DOCUMENTS

| | | | |
|---|---|---|---|
| 3,226,118 | 12/1965 | Nehl | 273/411 X |
| 3,399,889 | 9/1968 | Harry | 273/411 X |
| 3,940,139 | 2/1976 | Barnes | 273/411 |
| 3,980,299 | 9/1976 | Brown | 273/298 X |
| 4,135,716 | 1/1979 | Ginsburg | 273/29 BC |
| 4,415,163 | 11/1983 | Schoenig | 273/411 |
| 4,720,112 | 1/1988 | Stettner et al. | 273/411 |
| 4,732,395 | 3/1988 | Halverson | 273/411 |
| 5,156,408 | 10/1992 | Hall | 273/411 |

*Primary Examiner*—William H. Grieb
*Attorney, Agent, or Firm*—H. John Barnett

[57] ABSTRACT

A support stand for a volleyball net comprising five separable components including a two-part, tubular pole section and a three-part, tubular base. The base comprises a tubular T-joint having two 45 degree elbows in a common plane with the T-joint, and a right angle elbow extending out from the intermediate, right angle opening of the T-joint. Removable leg sections fit into the outer ends of the 45 degree elbows to orient the base so that the outer end of the right angle elbow opens vertically upward to receive the lower end of the two-part tubular pole section. The support stand is held in place by the volleyball net and a pair of guy lines which attach to the top of the pole section and are anchored to the ground.

2 Claims, 1 Drawing Sheet

FIVE-PART SUPPORT POST FOR VOLLEYBALL NET

BACKGROUND OF THE INVENTION

Field of the Invention

This invention relates to support stands for volleyball nets. More particularly, this invention is directed to a collapsible support stand from which the volleyball net is suspended.

Description of the Related Art

The following patents relate to supports for portable nets:

| Patent Number | Inventor | Date |
|---|---|---|
| 3,399,889 | Harry | 1968 |
| 3,940,139 | Barnes | 1976 |
| 3,980,299 | Brown | 1976 |
| 4,135,716 | Ginsburg | 1979 |
| 4,415,163 | Schoenig | 1983 |

Harry's patent, FIG. 6, shows support posts for volleyball nets. However, the support posts of Harry require connecting members 13 which fit inside the adjacent sections of the support stands. The connecting members are solid metal rods, and it appears that there are no positive stops to prevent the connecting members between two straight tubes from extending an unequal distance into the adjacent tubes.

Barnes shows a net support post which appears to include a vertical sleeve in which the bottom of the post is inserted. The support stand is not further described.

The Ginsburg stand elevates the post from the ground, and appears to be made from stamped metal, aluminum being preferred. The upper post is shown to be slidable in the lower post, and is apparently secured by means of an eye bolt and nut which extends through aligned openings in the upper and lower post sections. Ginsburg includes raised support legs similar to a Christmas tree stand. Weights, such as sand bags are placed on the longest leg for added stability.

The Brown patent includes a flat circular base into which a vertical net support post is threaded. The circular base is held in place by large headed spikes which are pounded through openings in the base to anchor it to the ground.

Schoenig's poles are telescopically adjustable, and include clamps to fix the height. The bottoms of the poles 12 and 14 rest in cups 24 and 26. Schoenig has no support base, and depends entirely on lines 74, 76, 78 and 80 and the net 10 to maintain the poles 12 and 14 in an upright position.

SUMMARY OF THE INVENTION

This invention is directed to a five part support post for a volleyball net which comprises five separate pieces that can be quickly assembled to provide a strong and stable post for a volley ball net. The post comprises a two part, tubular pole section and a three part tubular base. The base comprises a T-joint having two fortyfive degree elbows extending out from the opposite ends of the T-joints in the same plane into which tubular leg sections are inserted. A right angle elbow extends out from the intermediate, right angle opening of the tee coupling. The outer end of the right angle coupling extends vertically upward to receive the lower end of a volleyball net post when the fortyfive degree couplings and leg sections are horizontally disposed.

The post comprises lower section having lower end which is inserted into the vertical end of the right angle coupling and held there by gravity. The post has an upper end which terminates in a straight coupling which is permanently secured to the lower section of the post. An upper section of the post has a lower end which is received in the upper end of the straight coupling, and is held there by gravity. The net attaching eye bolts are secured to the inner side of the upper section of each post. In addition, an eye bolt is provided on the outer side of the top of each post for attaching a pair of guy lines which are staked to the ground at their outer ends for added stability.

Figure 1:
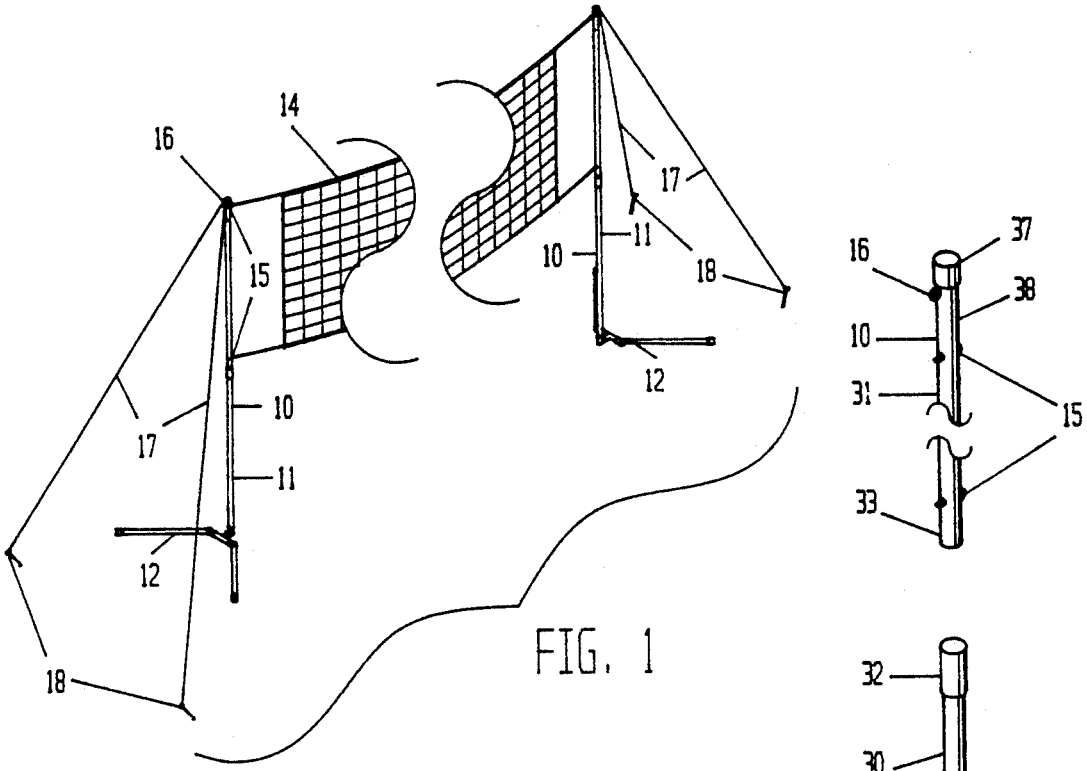
FIG. 1 of the drawing is a schematic perspective view, with parts broken away, which shows the volleyball posts of the invention assembled with a net attached, and the guy lines in place.

As shown in the drawings, each post 10 includes a vertical pole 11 and a base 12 which support a volleyball net 14 therebetween. Net 14 is secured to posts 10 by conventional eye bolts 15. Also provided at the tops of poles 10 is another eye bolt 16 for attaching conventional guy lines 17 which are anchored to the ground at their outer, lower ends by stakes 18.

Figure 2:
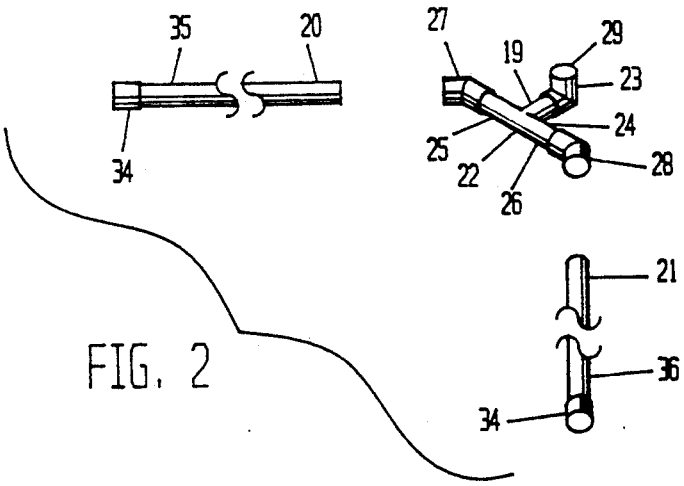
FIG. 2 is a schematic enlarged and exploded view, with some parts broken away, of one of the volleyball posts of the invention showing where the parts separate for assembly and disassembly.

Going now to FIG. 2, each base 12 comprises three parts: a middle section 19, and two leg sections 20 and 21. The middle section 19 includes a T-joint 22 to which is secured a 90 degree elbow 23 at its intermediate, right angle leg 24. The outer legs 25 and 26 of the T-joint 22 are secured to a 45 degree elbow 27 and 28, into which the leg sections 20 and 21 are fitted, respectively when the base 12 is assembled. The outer end 29 of the 90 degree elbow 23 then is vertically disposed to receive and support the post 10.

Each post 10 comprises a lower section 30 and an upper section 31, which slip fit together. The lower section 30 includes a union 32 which is secured thereto, and which receives the lower end 33 of the upper section 31 to form the post 10. Caps 34 may be provided to close the outer ends 35 and 36 of the leg sections 20 and 21. A cap 37 may also be provided to close the upper end 38 of the post 10.

At the present time, the volleyball post 10 is fabricated from 1 ¼ inch I.D. polyvinyl chloride tubing and fittings which will withstand 370 p.s.i. at 73 degrees F. The material is non-corrosive, inexpensive and strong. The straight union 32 is permanently bonded to either the lower end of the upper section 31 of the post 10, or to the top of the lower section 30 to facilitate quick assembly an disassembly.

The middle section 19 of the base 12 is shown having a male T-joint 22, which is assembled and bonded with its outer ends inside the inner female openings of the respective 45 degree elbows 27 and 28. It is also possible to permanently bond the components of the middle section 19 using a female T-joint 22 and very short pipe sections (not shown). If the male T-joint is available, only one half the bonding steps are required to fabricate the middle section 19 of the base 12. The ninety degree elbow 23 is also permanently bonded to the intermediate, right angle leg 24 of the T-joint 22. The ninety degree elbow 23 is disposed with it outer end 29 perpendicular to the common plane of the T-joint 22 and the 45 degree elbows 27 and 28, so that when the base 12 is disposed on a horizontal surface, the outer end 29 of the ninety degree elbow is vertical.

The assembled posts are strong and resilient, and readily absorb the frequent impacts against the net and the posts which occur during play. The posts are resistant to damage during transport and storage, and can be quickly and easily reassembled at the correct height for regulation volleyball posts.

The disassembled parts of the posts can be easily fitted into the trunk or storage compartment of most vehicles. Reassembly is simple and fast.

What is claimed is:

1. A portable volleyball net support post comprising:

a post comprising first and second tubular sections interconnected by a straight tubular coupling having two ends, said coupling being permenently secured on one end to one of the post sections, and removably connected to the other end to the other post section; and a tubular support base comprising a middle section having a central T-coupling having two end openings and an intermediate, right angle opening, a pair of 45 degree elbows extending laterally outward from the end openings of the T-coupling, said 45 degree elbows being disposed in a common plane with said T-coupling, and a 90 degree elbow having an outer opening extending outwardly at a right angle from the common plane of the 45 degree elbows and the T-coupling, and a pair of leg sections, each adapted to releasably connect to the outer opening of the respective 45 degree elbows, and to lie in the common plane therewith, whereby said support post can be disassembled into five portable section and reassembled into a support post by simply refitting the parts together.

2. The portable volleyball net support post of claim 1, in which the tubular post sections and the tubular base sections comprise 1 ¼ inch I.D. polyvinyl chloride tubing and fittings capable of withstanding 370 p.s.i. at 73 degrees F.

* * * * *